US005675105A

United States Patent [19]

Simon et al.

[11] Patent Number: 5,675,105

[45] Date of Patent: Oct. 7, 1997

[54] FIRING ABORT AND HANG FIRE SAFETY SYSTEM FOR A SMALL OR MEDIUM CALIBRE MULTI-BARREL AUTOMATIC WEAPON

[75] Inventors: Georges Simon, Saint Germain du Puy; Patrice Pichot, Bourges, both of France

[73] Assignee: CTA International, Versailles, France

[21] Appl. No.: 676,404

[22] PCT Filed: Dec. 12, 1995

[86] PCT No.: PCT/FR95/01645

§ 371 Date: Sep. 12, 1996

§ 102(e) Date: Sep. 12, 1996

[87] PCT Pub. No.: WO96/18863

PCT Pub. Date: Jun. 20, 1996

[30] Foreign Application Priority Data

Dec. 12, 1994 [FR] France ..... 94/14910

[51] Int. Cl.[6] ..... F41F 1/00

[52] U.S. Cl. ..... 89/12; 89/1.41; 89/27.12; 89/126; 89/160

[58] Field of Search ..... 89/12, 1.41, 27.12, 89/126, 160, 163

[56] References Cited

U.S. PATENT DOCUMENTS

| | | | |
|---|---|---|---|
| 4,193,335 | 3/1980 | Tassie | 89/7 |
| 4,274,325 | 6/1981 | Snyder et al. | 89/12 |
| 4,841,835 | 6/1989 | Bohler et al. | 89/12 |
| 4,924,753 | 5/1990 | Tassie et al. | 89/160 |
| 5,127,309 | 7/1992 | Menges et al. | 89/11 |

FOREIGN PATENT DOCUMENTS

| | | |
|---|---|---|
| C-36 27 355 | 4/1992 | Germany . |
| C-36 27 362 | 4/1992 | Germany . |
| A-675767 | 10/1990 | Switzerland . |

*Primary Examiner*—J. Woodrow Eldred
*Attorney, Agent, or Firm*—Oliff & Berridge

[57] ABSTRACT

A firing abort and hang fire safety system for a small or medium caliber multi-barrel automatic weapon includes a device to immobilize the revolving assembly (100) of the weapon in rotation. This device includes a shock-absorbing device mounted coaxially to the revolving unit of the weapon, a control device integral in rotation with the revolving unit and able to translate, further to the misfire of a round of ammunition or to the activation of an external control, to compress the shock-absorbing means device and absorb the rotational kinetic energy of the revolving unit of the weapon. The backspring of the shock-absorbing means device thereafter causing the revolving unit of the weapon to rotate in the opposite direction before stopping.

25 Claims, 10 Drawing Sheets

FIRING ABORT AND HANG FIRE SAFETY SYSTEM FOR A SMALL OR MEDIUM CALIBRE MULTI-BARREL AUTOMATIC WEAPON

BACKGROUND OF THE INVENTION

The invention relates to a firing abort and hang fire safety system for a small or medium calibre multi-barrel automatic weapon. The weapon includes a body which supports in rotation an assembly revolving around an axis parallel to the direction of fire of the weapon barrels. The revolving assembly includes notably the weapon barrels and an ammunition loading and firing system so that the weapon barrels successively fire one round of ammunition during each revolution of the revolving assembly.

In such a weapon, of the GATLING type, the role of the firing abort and hang fire safety system is essentially that of controlling the immobilization of the revolving assembly of the weapon be it in response to the deliberate activation of an external control to abort firing, for example during or after the firing of a burst of ammunition, or automatically for safety reasons further to the misfire of a round of ammunition by one of the weapon barrels.

SUMMARY OF THE INVENTION

The main aim of the invention is to design a firing abort and hand fire safety system in which the revolving assembly of the weapon can be immobilized in the best possible conditions given the kinetic energy of the revolving assembly at the instant of activating the firing abort or hang fire safety system.

The invention proposes a firing abort and hang fire safety system for a small or medium calibre multi-barrel automatic weapon, which is characterised in that it comprises a system to immobilizing the revolving assembly of the weapon in rotation. The system incorporates shock-absorbing means mounted coaxially to the revolving assembly of the weapon, a control device comprising a cylindrical body which is coaxial to and integral in rotation with the revolving assembly and is also able to translate, and means to cause the translational movement in response to the detection of the misfire of a round of ammunition or to the activation of an external control to abort firing, to compress the shock-absorbing means and absorb the rotational kinetic energy of the revolving assembly of the weapon, thereby triggering the shock-absorbing means and thereafter causing the revolving assembly to be rotated in the opposite direction to the one in which it was moving before firing was aborted.

The rotational axis of the revolving assembly is provided by a fixed central shaft which is extended axially by a rod. One end of the rod is attached to the central shaft by means of a coupling. The other end of the rod supports a locking ring.

The shock-absorbing means can be formed of two stacks of spring-rings respectively housed in two telescopic tubes mounted sliding along the rotational axis of the revolving assembly.

The first telescopic tube comprises at one end a bottom wall through which the central rod passes. The second telescopic tube, which is intended to be engaged at one end in the other open end of the first telescopic tube, also comprises a bottom wall through which the central rod passes, such that the spring-rings of the first stack bear respectively on the two bottom walls of the two tubes. The spring-rings of the second stack respectively bear on the bottom wall of the second telescopic tube and on the locking ring carried by the central rod.

The means causing the translational movement of the cylindrical body, which enables the shock-absorbers to be compressed, comprise a sleeve, which encompasses the cylindrical body, linking means between the sleeve and the cylindrical body to firstly drive the sleeve in synchronised rotation with the cylindrical body and secondly to enable the translational movement of the cylindrical body with respect to the sleeve, and a device to stop the sleeve in rotation so as to cause the translational movement of the cylindrical body. The stopping device is activated in response to the misfire of a round of ammunition or to the external control to abort firing.

The linking means between the element, which enables the shock-absorbing means to be compressed, and the sleeve are formed of a cam-follower located at the periphery of the cylindrical body, hereafter named cam-follower-mount, and by helicoidal grooves arranged in the sleeve wall, such that each groove receives a cam-follower.

The device to stop the sleeve in rotation comprises a plurality of heels evenly spaced at the periphery of the sleeve and a retractable sear immobile in rotation with respect to the sleeve and able to move between a lowered or retracted position and a raised position where the sear is located on the course of circular movement of the heels to be able to immobilize the sleeve in rotation.

According to another characteristic of the invention, the number of heels of the sleeve is equal to that of the barrels of the weapon, such as to match each heel to a barrel.

The sear is formed of a pivoting flap hinged around an axis supported by a sear support which is immobile in rotation with respect to the sleeve and which is mounted opposite the latter.

In considering only a full revolution of the sleeve and the rotational direction of the latter, the heel associated with a barrel of the weapon passes in front of the sear after the ammunition fired from the barrel has been ignited and before ignition of the ammunition fired from the next barrel.

The device to stop the sleeve in rotation is notably activated in response to the detection of a misfire in the firing of a round of ammunition. The failure can be detected by observing the absence of combustive gases or of a recoil movement of the weapon within a given lapse of time. Further on, detection means, which are sensitive to the combustive gas pressure, will be considered.

The passage of the sear into its lowered and/or raised positions is ensured by one of several detection and control means mounted on a support integral in rotation with the revolving assembly of the weapon. The number of the control means is equal to the number of weapon barrels so as to match a barrel to each control means.

Each control means can be formed of an element able to move between a retracted position and an active position where it can act upon the sear. The element is able to move from one position to another by making use of the combustive gases of the ammunition fired by the barrel corresponding to the control means. The mobile element can be the piston rod of a jack, whose cylinder communicates with the barrel corresponding to the mobile element.

The invention envisages two operating principles according to the position occupied by the retractable sear under normal operating conditions of the weapon.

According to a first embodiment and under normal operating conditions of the weapon, the sear is in the raised position before a round of ammunition is fired, which implies a first operating principle according to which the sear must be retracted after firing a round of ammunition from one barrel so that the heel of the sleeve corresponding to the barrel can pass freely in front of the sear, the latter thereafter being raised after the passage of the heel and before firing a round of ammunition from the following barrel.

In the first embodiment, a device is provided to lower the sear and another device to raise it, the two devices being successively activated by the control means corresponding to the barrel which has just fired a round of ammunition. The mobile element of the control means is in its retracted or starting position before the round of ammunition is fired and, under normal operating conditions of the weapon, moves into its active position when the round is fired by making use of the combustive gases.

The devices to lower and raise the sear are both formed of a linkage connected in a hinged manner to the sear to make it pivot in one or other direction. Each of these linkages comprises at least one means forming a cam which is located on the course of movement of the mobile element of the control means corresponding to the barrel having fired a round of ammunition when the control element is in its active position so as to act successively on the cams of the devices to lower and raise the sear.

When a malfunction occurs upon firing a round of ammunition from one of the barrels of the weapon, such as, for example, a failure causing the round not to be fired or a delay in firing the round, the mobile element of the control means of the defective barrel remains in its starting position because of the absence or delay of the combustive gases. In these circumstances, the cams of the devices to lower and raise the sear are no longer located on the course of movement of the mobile element and the sear is thus held in the raised position, that is, on the course of movement of the heels of the sleeve. The heels corresponding to the defective barrel will abut, in this case, against the sear thereby causing the immobilization in rotation of the sleeve.

The external control to abort firing during burst fire, for example, is designed so as to retain the mobile element corresponding to one of the barrels of the weapon in its retracted position when the barrel is going to fire a round of ammunition. In other words, the action of the combustive gases on the mobile element is eliminated at the instant of firing. Thus, the sear is held in its raised position after firing the munition and it will cause the sleeve to be immobilized in rotation and the cam-follower-mount to translate, as would be the case for a malfunction at the instant of firing a round of ammunition.

In these circumstances, the shock-absorbing means are still controlled further to the immobilization in rotation of the sleeve, whether for the misfire of a round or in the case of the activation of the external control to abort firing.

According to a second embodiment and under normal operating conditions of the weapon, the sear is held in its lowered position, which implies a second operating principle opposite to that described previously.

In the second embodiment, a device is provided to hold the sear in its lowered position and another device is provided to raise the sear solely after the misfire of a round of ammunition or after the activation of the external control to abort firing so as to cause the sleeve to be immobilized in rotation.

The mobile element of the control means corresponding to each barrel of the weapon is, however, in its active position before the round is fired, and the gases are made use of at the instant of firing to move the mobile element in its retracted position so that it can not act upon the device to raise the sear. In fact, the device to raise the sear comprises, as in the first embodiment, a cam located on the course of movement of the mobile element of the control means when the mobile element is in its active position.

In these circumstances, when a malfunction occurs at the instant of firing a round from one of the barrels, as was stated previously, the mobile element of the control means corresponding to the barrel remains in its active position to be able to act on the device enabling the sear to be raised before the passage of the heel of the sleeve corresponding to the barrel and the sleeve to be immobilized in rotation when the heel comes into contact with the sear.

The external control to abort firing during burst fire, for example, is designed so as to retain the mobile element of the control means corresponding to one of the barrels in its retracted position, as is the case in the first embodiment, when the barrel fires a round to be able to act on the device which raises the sear before the passage of the heel of the sleeve corresponding to the barrel which fires the round and thereby cause the sleeve to be immobilized in rotation.

The external control to abort firing in the two embodiments is only provided to act on one of the barrels of the weapons. In these circumstances, when the external control to abort firing is activated during burst fire, the weapon can still fire a number of rounds at least equal to the number of barrels of the weapon before the weapon actually stops, in other words the weapon can not fire shot-by-shot. This mode of operation does not present any great interest for a GATLING type weapon.

This second embodiment has the notable advantage of easing wear on all the mechanisms which are used to lower and raise the sear. Indeed, for each rotation of the revolving assembly of the weapon under normal operating conditions, the first embodiment requires the sear to be lowered and raised a number of times equal to the number of barrels, whereas in the second embodiment the sear remains in the retracted position and the mechanisms to lower and raise the sear are not put under stress.

Thus, according to one important advantage of the invention, the kinetic energy of the revolving assembly of the weapon is absorbed by shock-absorbing means, which prevents an almost instantaneous immobilization with the risk of creating substantial mechanical stresses on the bearings of the rotational supports of the revolving assembly of the weapon.

BRIEF DESCRIPTION OF THE DRAWINGS

Other advantages, characteristics and particulars of the invention will become apparent from the explanatory description which follows made in reference to the appended drawings, given merely by way of illustration, and in which.

DESCRIPTION OF THE PREFERRED EMBODIMENTS

Figure 1:
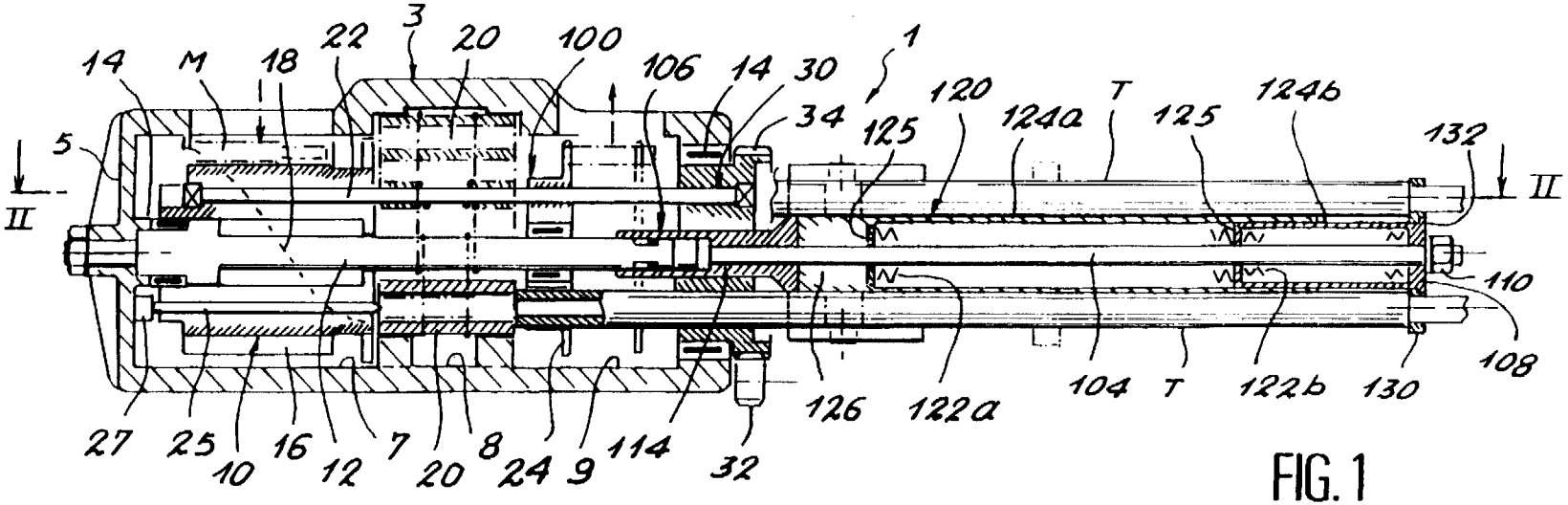
FIG. 1 is a longitudinal schematic sector view of a weapon equipped with a firing abort and hang fire safety system according to the invention and according to a first embodiment.
Figure 2:
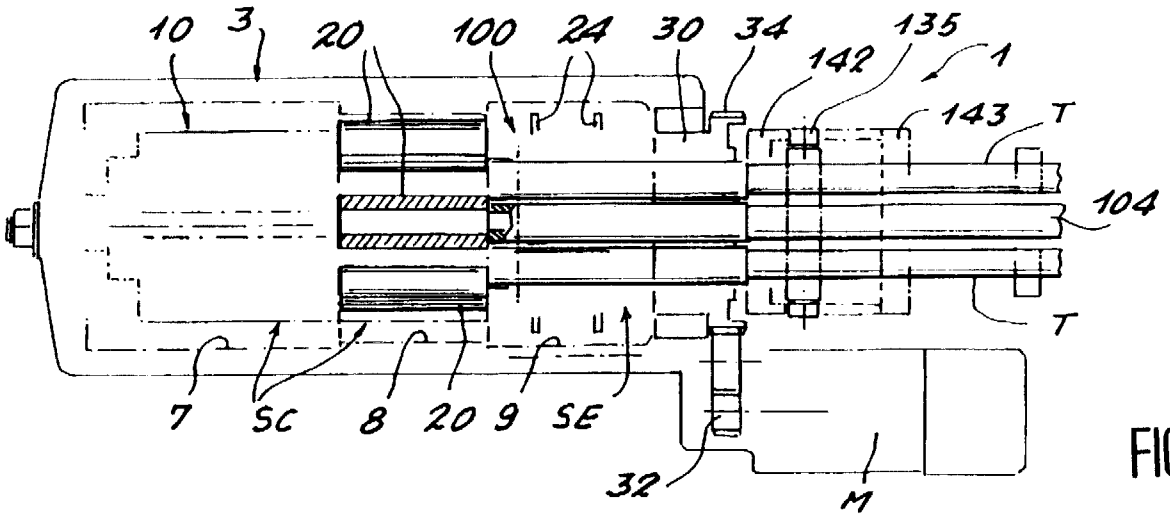
FIG. 2 is a sector view along line II—II in FIG. 1.

A small or medium calibre multi-barrel automatic weapon is illustrated schematically in FIGS. 1 and 2. The weapon 1, of the GATLING type, incorporates a body 3 which supports a revolving assembly in rotation.

The revolving assembly notably includes the barrels T of the weapon, of which there are for example four, and an ammunition M loading and firing system SC so that the barrels T successively fire one round of ammunition during each full revolution of the revolving assembly.

The body 3 of the weapon 1 is hollow and has an elongated shape and extends between a rear end which is closed by a bottom 5. The body 3 a front end which is open leaving a free passage for the barrels T. Three successive housings 7, 8 and 9 are defined inside the body 3 between its rear and front end (FIG. 2).

The loading and firing system SC includes a loading unit 10 which is rotatably mounted of the housing 7 in the body 3. The loading unit 10 is rotatable around a fixed central shaft 12 by means of bearings 14. The loading unit 10 has a roughly cylindrical shape and includes, at its periphery, indentations forming chutes 16 to receive the rounds of ammunition M. A fixed helicoidal ramp 18, formed on the inner wall of the housing 7 in the body 3 of the weapon, ensures that the rounds move along the chutes 16 during the rotational movement of the loading unit 10.

The loading and firing system SC also includes several chambers 20 mounted around the fixed central shaft 12 inside the housing 8 of the body 3. For example, there can be four chambers 20, each chamber corresponding to a barrel of the weapon. Each chamber is mounted to rotate around a stay 22, parallel to the fixed central shaft 12, and integral in rotation with the loading unit 10. During the rotation of the loading unit 10, the chambers 20 can be guided between two fixed cams, separated from one another by a invariable distance matching the outer diameter of the chambers 20.

Thus, during a full revolution of the loading unit 10, four successive zones can be defined:

—a loading zone where a first chamber 20 is open and offset sideways with respect to its corresponding barrel T to load a round, —a closing zone where a second chamber 20 containing a round moves gradually from its open to its closed position, —a firing zone where a third chamber 20 is closed and axially aligned with its corresponding barrel T, and —an opening zone where the fourth chamber 20 moves gradually from its closed position to its open position.

It is important to note, for the following, that during its whole movement in the firing zone, a chamber is axially aligned with the barrel of the weapon to which it corresponds.

A system SE, for ejecting the cases of the rounds that have been fired, is mounted in the housing 9 of the body 3.

The system SE can include two star wheels 24, coaxial to the shaft 12 and integral in rotation with the stays 22.

Four percussion devices 25, one device per chamber, are housed inside the loading unit 10. Each percussion device 25 is activated by a control device 27.

The housing 9 which houses the system SE to eject the cases is closed off by a part 30. The part 30 supports the stays 22 as well as the barrels T which extend beyond the part 30, which is integral in rotation with the loading unit 10 (FIG. 1).

With reference to FIG. 2, an external motor component M, such as a back-geared motor, has an output shaft which supports a drive wheel 32. The drive wheel 32 meshes with a toothing 34 provided on the periphery of the support part 30 to drive the revolving assembly of the weapon in rotation.

The revolving assembly 100 of the weapon includes the loading unit 10, the stays 22 and the corresponding chambers 20, the barrels T and the system SE for ejecting the ammunition cases. An assembly to which a firing abort and hang fire safety system is added ensures that the revolving assembly 100 of the weapon is immobilized further to the misfire of a round of ammunition from one of the barrels T of the weapon or activated by an external control to abort fire.

Figure 3:
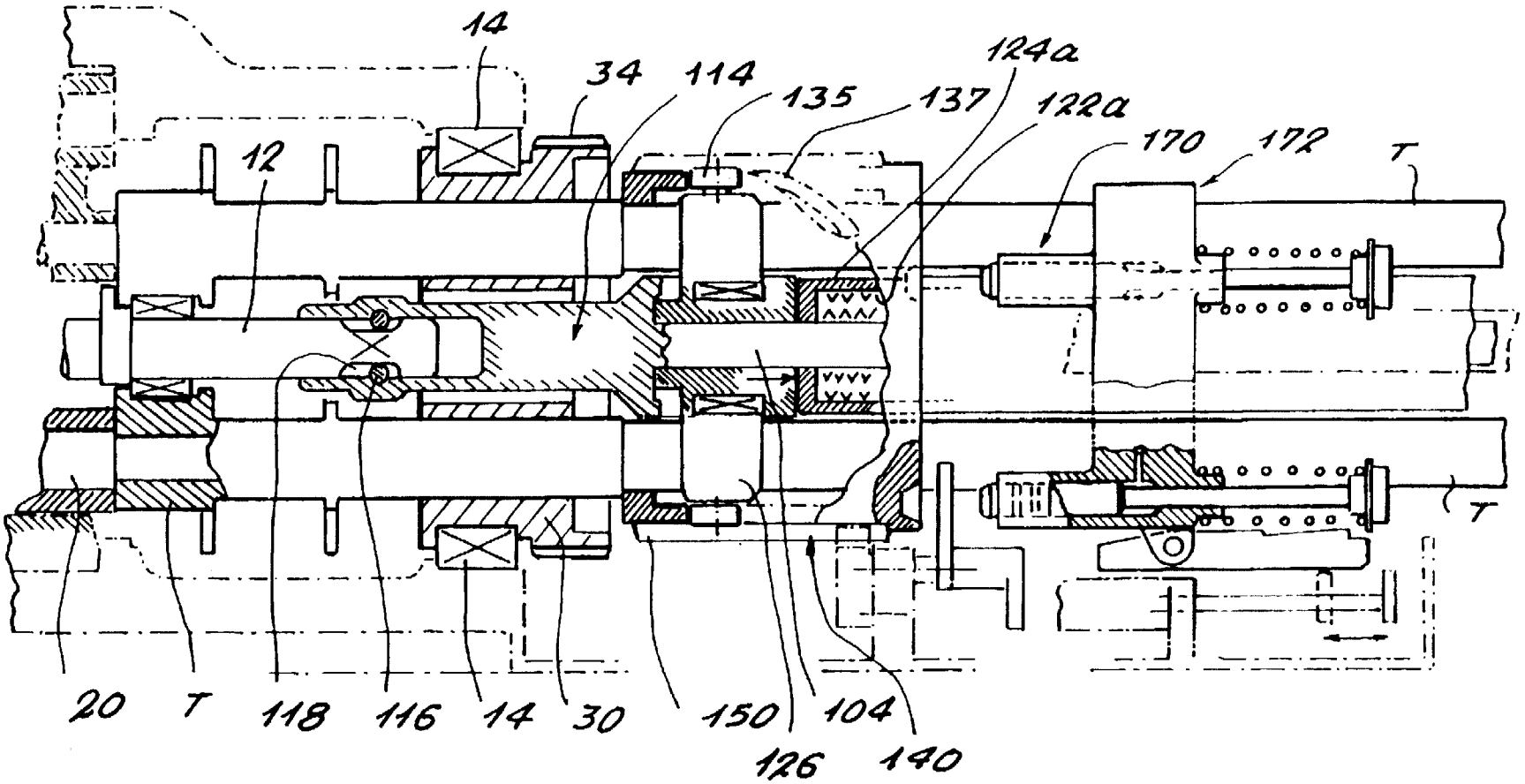
FIG. 3 is a partial sector view of a firing abort and hang fire safety system.

Generally speaking, and with reference to FIGS. 1 to 3, the fixed central shaft 12, which passes through the revolving unit 100 of the weapon, is axially extended by a central rod 104, one end of which is attached to the shaft 12 by a coupling 106. At its other end, the rod 104 supports a bearing washer 108 retained by a nut 110 screwed onto the rod 104 through which the barrels T of the weapon pass.

The coupling 106 includes a sleeve 114 integral with the rod 104 and slidably mounted on the said shaft 12. As can be seen in FIG. 3, two fixed pins 116 are engaged in the body of the sleeve 114, perpendicular to the axis of the latter, so as to project radially in two axial slots 118. The slots 118 are diametrically opposite one another and arranged at the peripheral surface of the central shaft 12. The two ends of the slots 118 each form an abutment which limits the axial movement of the sleeve 114 of the coupling 106.

The firing abort and hang fire safety system includes a system 120 to immobilize the revolving assembly 100 of the weapon in rotation. With reference to FIG. 1, the system 120 includes a shock-absorbing device formed of two stacks of spring-rings 122*a* and 122*b* respectively housed in two telescopic tubes 124*a* and 124*b* slidably mounted on the central rod 104.

More specifically, the first telescopic tube 124*a* comprises, at one end, a bottom wall 125 through which the central rod 104 passes and intended to rest against a cylindrical support unit 126 placed between the coupling 106 and the first telescopic tube 124*a*. The support unit 126 will be described later on. At its other end, the first tube 124*a* is open so as to receive, in a telescopic manner, the end of the second tube 124*b*.

The end of the second tube 124*b* which is engaged inside tube 124*a* also includes a bottom wall 125 through which the central rod 104 passes. Thus, the spring-rings 122*a*, housed in the first tube 124*a* and arranged around the central rod 104, are held between the two bottom walls 125 of the two tubes 124*a* and 124*b*. Whereas the spring-rings 122*b* housed in the second tube 124*b* and arranged around the central rod 104, are held between the bottom wall 125 of tube 124*b* and the bearing washer 108 provided at the free end of the central rod 104. Towards its other open end, the second tube 124*b* extends slightly beyond the bearing washer 108, which has a diameter which is slightly less than the inner diameter of tube 124b, and freely passes through a radial plate 130 through which the four barrels T of the weapon also pass and which is integral with the latter. The second tube 124b ends with an radial outer rim 132 intended to rest against the plate 130 thus limiting the degree to which tube 124b is able to travel within tube 124a.

A control device, for compressing to compress the spring-rings 122a and 122b of the shock-absorbing device, includes the aforementioned cylindrical support unit 126 which is fitted between the coupling 106 and tube 124a. The support unit 126 is mounted coaxially and is integral in rotation with the revolving assembly 100, while remaining able to translate along the barrels T of the weapon which pass through it. The control device for compressing the spring-rings 122a and 122b also includes a mechanism, described below, for causing the support unit 126 to translate further to the misfire of a round of ammunition or to the activation of the external control to abort fire.

Figure 4:
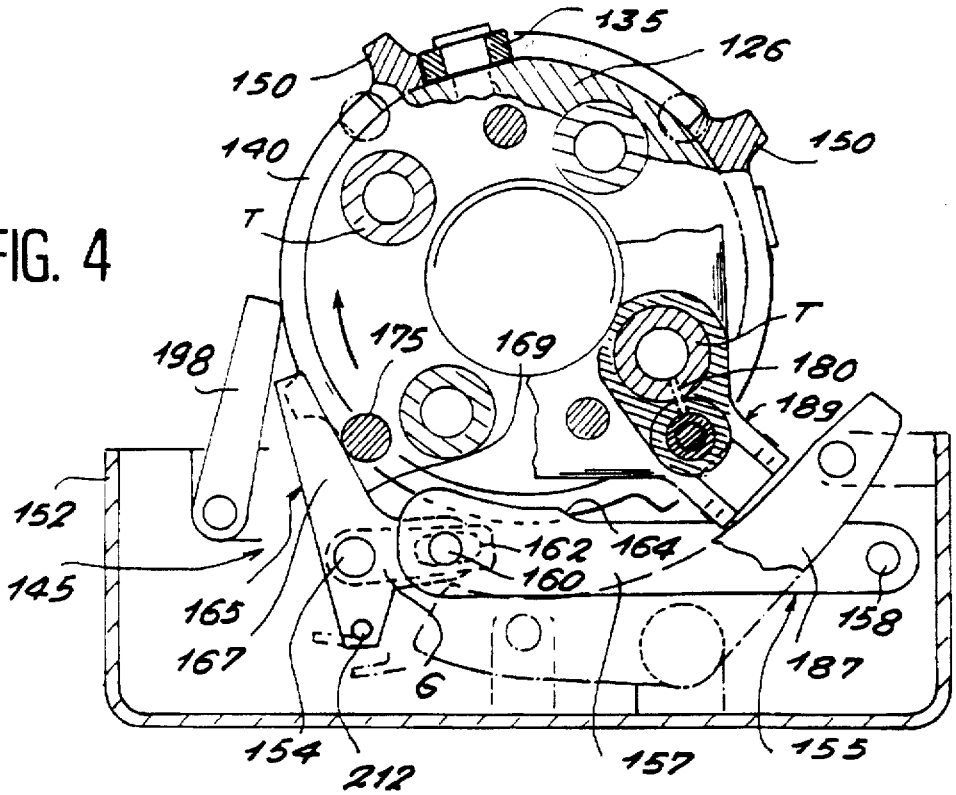
FIG. 4 is a partial sector view to illustrate the control principle of the firing abort and hang fire safety system.
Figure 5:
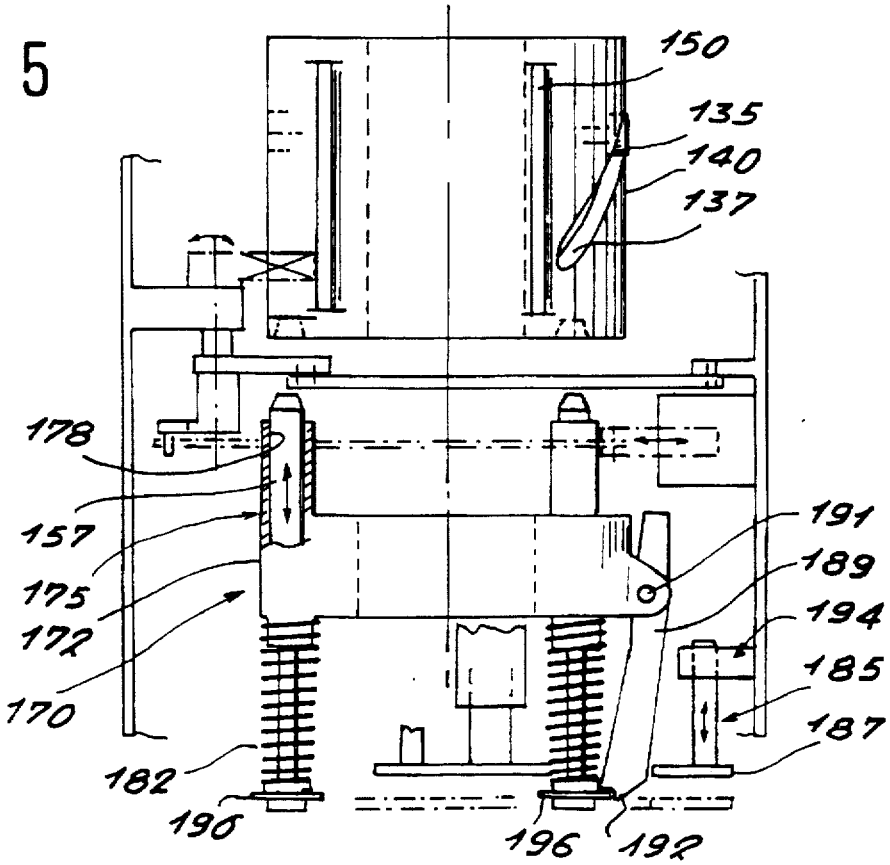
FIG. 5 is a schematic view of the firing abort control.

With reference to FIGS. 3, 4 and 5, the support unit 126 supports cam followers 135 at its periphery which are evenly spaced around this unit, hereafter termed cam-follower mount 126. The cam-followers 135 are respectively accommodated in helicoidal grooves 137 arranged in the cylindrical wall of a sleeve 140. This sleeve 140 is brought around the cam-follower mount 126 and is supported in rotation by two braces 142 and 143 (FIG. 2).

The cam-followers 135 transmit the rotational movement of the cam-follower mount 126 to the sleeve 140 while allowing the mount to translate when the sleeve 140 is immobilized in rotation by a stopping device 145.

The stopping device 145, such as that shown in FIG. 4, is formed of a retractable sear G able to cooperate with one of several heels 150 evenly spaced around the sleeve 140. The number of heels 150 is equal to the number of barrels of the weapon, so that a heel 150 corresponds to each barrel T.

Generally speaking, the sear G is rotatably immobile with respect to the revolving assembly 100 of the weapon. The sear G is pivotally mounted on a unit or sear support 152 facing the sleeve 140.

The sear G is formed of a roughly rectangular shaped flap, one side of which forms an abutment for the heels 150 of the sleeve 140. The sear G is mounted to pivot around a fixed axis 154 supported by the sear support 152. The sear G extends parallel to the rotational axis of the revolving assembly 100 provided by the central shaft 12 and the rod 104.

The sear G can adopt either a lowered or retracted position to avoid being on the course of movement of the heels 150 during the rotation of the sleeve 140, or can be raised so as to lie on this course of movement at a point so that the first heel can contact the sear G to immobilize the sleeve 140 in rotation is the one which corresponds to the barrel T located in the firing zone of the operating cycle of the weapon, that is as long as the chamber is axially aligned with the barrel.

According to a first embodiment, the sear G is in a raised position before a round of ammunition is fired from one of the barrels T of the weapon. As a result, under normal operating conditions of the weapon, the sear G must be lowered after a round has been fired and raised before firing the next round of ammunition.

With reference to FIG. 4, the device 155 to lower the sear G is formed of a pivoting lever 157, one end of which is hinged around a fixed point 158 on the sear support 152. The other end of the lever 157 is hinged on the sear G so that a pivoting movement of the lever 157 drives a pivoting movement of the sear G around its axis 154. The hinge between the lever 157 and the sear G can be formed by a pin 160 carried by the lever 157 and an oblong slot 162 arranged in the sear G to accommodate the pin 160. The lever 157 supports a boss 164 which forms a contact surface forming a cam which is used to pivot the lever 157 and lower the sear G.

The device 165 for raising the sear G (FIG. 4) is formed by a cam 167 simultaneously which is integral with the sear G. Thus the cam 167 can pivot with the sear G around the hinge pin 154. The cam 167 marks out a bearing surface 169 which bears a control mechanism for raising the sear G.

In this first embodiment, the devices 155 and 165 for lowering and raising the sear G are successively activated by one of several detection and control means 170. The control means 170 are mounted on a support 172 which is integral with the revolving assembly 100 of the weapon, and are equal in number to the barrels T of the weapon.

With reference to FIGS. 3 and 5, each control mechanism 170 is formed of a mobile element that can to take up either an active position used to control devices 155 and 165 to lower and raise the sear G by acting respectively on the boss 164 of the lever 157 and the the bearing surface 169 of the cam 167, or a neutral or starting position which involves no action on the sear G. The mobile element can be for example formed of the piston rod 175 of a jack 177. The mobile element can and also form a detection mechanism that is sensitive to the pressure of the combustive gases generated after firing a round.

A control mechanism 170 is associated with each barrel T, i.e., the cylinder 178 of the jack 177 corresponding to each barrel T is able to communicate with its corresponding barrel T, by means of a passage 180, in order to transmit part of the combustive gases resulting from the firing of a round to the cylinder 178 (FIG. 4). A return spring 182 brings the piston rod 175 back to its starting position after a round has been fired.

The firing abort and hang fire safety system enables the sleeve 140 to be immobilized in rotation either because a round of ammunition from one of the barrels has misfired, or by virtue of deliberate activation of an external control 185 to abort fire.

The external control 185 to abort fire (FIGS. 3 to 5) is immobile in rotation with respect to the revolving assembly 100. The external control 185 includes a sector 187 able to translate and which is intended to cooperate with a pawl 189 mounted pivoting around an axis 191 of the revolving support unit 172 of the jacks 177. The pawl 189 is positioned on the support unit 172 so as to be able to cooperate with the piston rod 175 of the control means 170 corresponding to one of the barrels T of the weapon. At one end, the pawl 189 is finished off by a hook 192. The firing abort sector 187 is controlled by an electromagnet 194.

Generally speaking, the piston rod 175 of each control mechanism 170 passes through the corresponding cylinder 178. However, the piston rod 175 associated with the pawl 189 also includes, at one end, a rim 196 intended to cooperate with the hook 192 which is able to immobilize the piston rod 175.

The normal operation of the weapon will now be described for a full revolution of the revolving assembly 100 and more particularly of the revolving sleeve 140, the rotation of which is ensured by the cam-follower mount 126 that is integral in rotation with this revolving assembly.

According to the operating principle of this first embodiment, the sear G is in the raised position before a round of ammunition is fired from any one of the barrels T. The piston rods 175 of the control means 170 of the sear G are each in their neutral or retracted position inside their respective cylinders 178.

This operation will be described only for a single barrel T of the weapon, the heel 150 of the sleeve 140 corresponding to this barrel T and the control mechanism 170 also associated with this barrel T to modify the position of the sear G.

When the barrel T comes into the firing zone, the firing pin 25 corresponding to this barrel is activated and the round of ammunition loaded in this barrel T is fired. Some of the gases resulting from the firing of the round work their way through to the cylinder 178 of the jack 177 corresponding to the barrel T via the passage 180. The piston rod 175 housed in the cylinder 178 then moves axially to take up an active position, a movement accompanied by the compression of its return spring 182.

Figure 7:
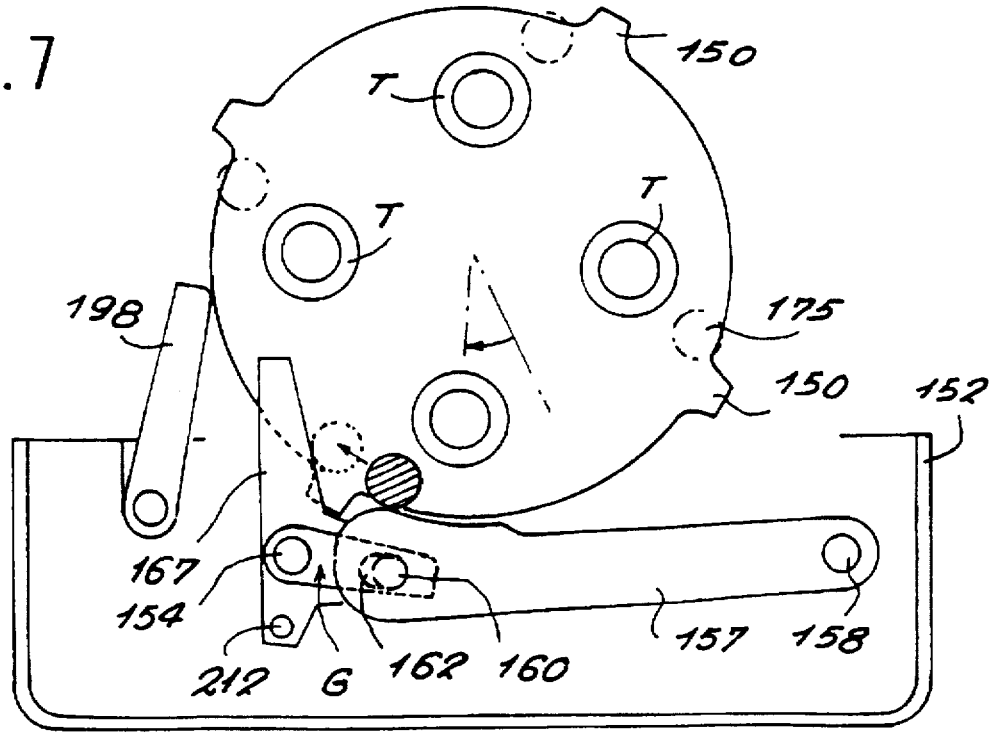

Given that the support unit 172 of the jacks 177 has a rotational movement which is synchronous with that of the sleeve 140 and the revolving assembly 100, the piston rod 175 will first contact the boss 164 of the lowering lever 155 to pivot this lever 155, lower the sear G and enable the heel 150 corresponding to the barrel T to move freely in front of the sear G (FIG. 7). The piston rod 175 then contacts the bearing surface 169 of the cam 167 to raise the sear G before a round of ammunition is fired by the next barrel.

Once the piston rod 175 has raised the sear G, the action of the combustive gases is no longer enough to retain the piston rod 175 in its active position, and the return spring 182 brings the piston rod back to its neutral or retracted position inside its cylinder 178.

Thus, under normal operating conditions of the weapon and for a full revolution of the sleeve 140, each barrel of the weapon fires a round with, after each fire, retraction of the sear G to provide a free passage for the heel 150 corresponding to the barrel T which has just fired a round, and the repositioning of the sear in its raised position before the following fire.

Figure 6:
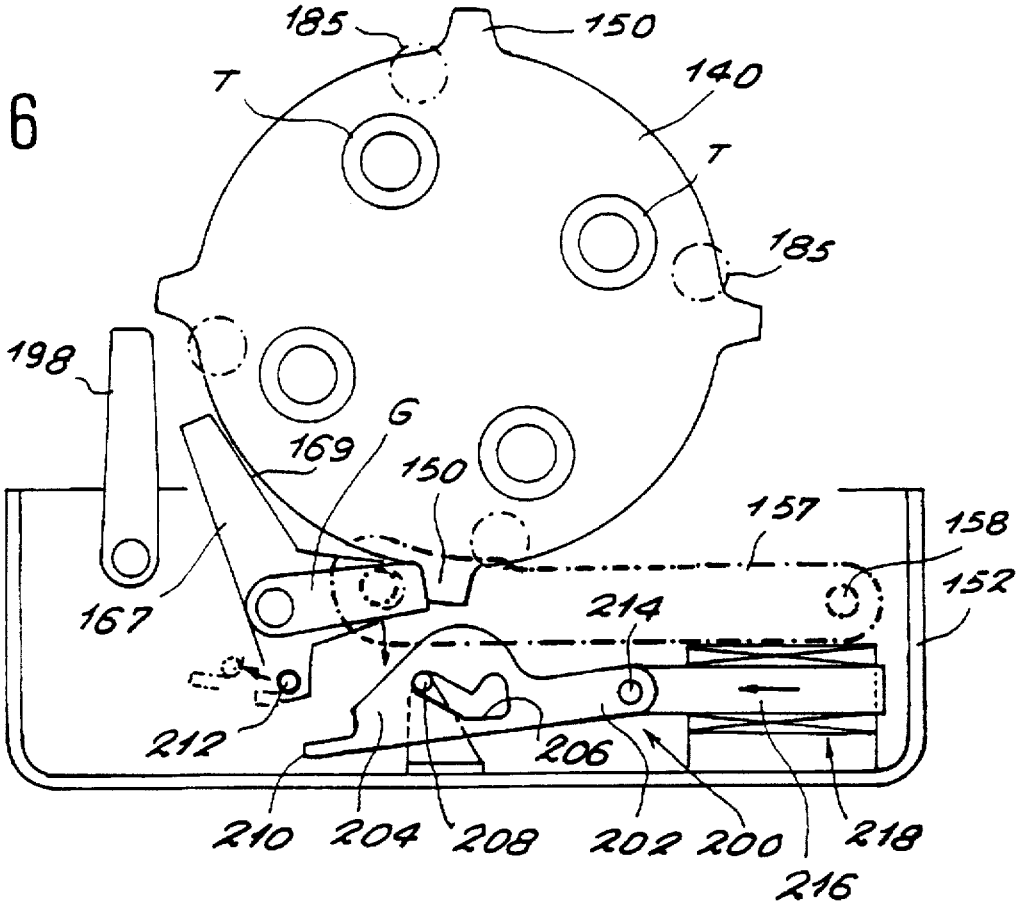
FIGS. 6 and 7 are similar views to that of FIG. 4 to illustrate the operation of the firing abort and hang fire safety system.

A malfunction may occur during the firing of a round of ammunition from one of the barrels T of the weapon, such as a failure causing the round not to be fired or a delay in firing this round. In this case, the absence or delay of the combustive gases prevents the piston rod 175 of the jack 177 corresponding to the barrel T from moving and to remain in its retracted position. In these circumstances, the boss 164 of the lowering lever 157 is no longer located on the course of movement of the piston rod 175 during the rotation of the unit 172 which supports the jacks 177, and as a result the sear G remains in its raised position. The sear G is thus located on the course of movement of the heel 150 corresponding to the barrel T and causes the sleeve 140 to be immobilized in rotation (FIG. 6).

In the event that a volley of fire is required to be aborted for example, each shot being carried out normally, the external control 185 merely has to be activated in order to abort fire by activating the electromagnet 194 to move the firing sector 187 into the course of movement of the pawl 189 supported by the support unit 172 of the control means 170.

As the pawl 189 passes, the sector 187 will force the pawl to swing around the axis 191 in the direction of the piston rod 175 of the control means 170 corresponding to the barrel T of the weapon to which the pawl 189 is attributed. The pawl 189 undergoes this swing when the barrel enters into the firing zone and before the round of ammunition contained in the chamber 20 of this barrel is ignited. As a result, the hook 192 of the pawl 189 is positioned against the rear rim 196 of the piston rod 175 (FIG. 5). In these circumstances, the gases resulting from firing the last round can not impel the rod to move. The heel 150 of the revolving sleeve 140 corresponding to the barrel T will therefore abut against the sear G of the stopping device 145 held in its active non retracted position. Thus, the revolving sleeve 140 is immobilized in rotation, as in the previous case further to the misfire of a round of ammunition (FIG. 6).

The presence of a single pawl 189 should be noted. In fact, such a solution proves advantageous in the event that the weapon operates at a high rate of fire, as it is difficult to associate a pawl 189 to each barrel of the weapon given that the time required for the sector 187 corresponding to each pawl to be set into position would be too short. On the other hand, with such a solution, the weapon cannot fire shot-by-shot, but has to fire a minimum number of shots equal to the number of barrels of the weapon.

When the sleeve 140 is immobilized in rotation further to the action of the sear G against which a heel 150 of the sleeve abuts, the action must be noted of a counter-sear 198, armed for example by a spring (not shown) which presses against the heel 150 which precedes the heels 150 immobilized by the sear G, so as to immobilize the sleeve 140 in both rotational directions (FIG. 6).

In the two cases described above, the immobilization in rotation of the revolving sleeve 140 causes the device 120 to stop the revolving assembly 100 of the weapon in rotation, and the stoppage of the drive motor M.

When the sleeve 140 is immobilized in rotation, the cam-follower mount 126 and the revolving unit 100 of the weapon continue their rotational movement, during which the cam-follower mount 126 also translates in the firing direction of the weapon further to the movement of the cam-followers 135 in the helicoidal grooves 137 of the sleeve 140 immobilized in rotation. When moving, the cam-follower mount 126 bears on the bottom wall 125 of the telescopic tube **124*a*, the effect of which is to compress the first stack of spring-rings 122*a*, then the second stack of spring-rings 122*b* which bears on the fixed plate 130 carried by the central rod 104**.

Thus, the effect of compressing the spring-rings **122*a* and 122*b* is to absorb the kinetic energy of the revolving assembly 100 of the weapon. When the return force of the spring-rings 122*a* and 122*b* becomes greater than the rotational driving force of the cam-follower mount 126, the latter and the revolving assembly of the weapon 100 are driven in an opposite rotational direction during which the cam-follower mount 126 also translates in the opposite direction to that having caused the compression of the spring-rings 122*a* and 122*b*. The kinetic energy of the revolving assembly 100 during this opposite rotational movement is absorbed by the second stack of spring-rings 122*b*, the length of which is less than that of the first stack of spring-rings 122*a*. The second stack is also stiffer as the kinetic energy to be absorbed is not so great during the reverse rotational movement of the revolving assembly 100. When the spring-rings 122*a* and 122*b* spring back, the telescopic tubes 124*a* and 124*b* initially driven in translation by the cam-follower mount 126 undergo a reverse translational movement. The second tube 124*b* is then immobilized further to its outer rim 132 pressing against the fixed plate 130, whereas the first tube 124*a* contacts the sleeve 114 of the coupling 106 which will be able to move towards the rear for a distance limited by the axial length of the slots 118 in which the fixed pins 116** are engaged.

Generally speaking, when the weapon is in its starting position, the sear G is not in a retracted position, such that one of the heel 150 of the revolving sleeve 140 abuts against the sear G. Before firing a volley of rounds for example, the sear G of the stopping device must be retracted.

To this end, the firing abort and hang fire safety system is completed by an additional retraction device 200 shown in FIG. 6.

The additional retraction device 200 includes a lever 202 which, towards one end or front end, is extended by a lateral boss 204 of a roughly triangular shape in which a guiding slot 206, of a bent shape, has been arranged and which accommodates a fixed pin 208. To its front end, the lever 202 is extended axially by a limit stop 210 intended to cooperate with a crank pin 212 carried by the control cam 167 of the device 165 to raise the sear G. The other end of the lever 202 is hinged at point 214 on the mobile element 216 of a control electromagnet 218.

When the electromagnet 218 is activated, the lever 202 moves in the direction of the stopping device 145 guided by its fixed pin 208 which moves in the slot 206. This movement is such that the limit stop 210 of the lever 202 presses upon the crank pin 212 of the control cam 167 so as to pivot it in order to retract the sear G, thus releasing the heel 150 of the revolving sleeve 140 which becomes free to rotate.

According to the first embodiment described above and under normal operating conditions of the weapon, the sear G must be lowered after firing a round of ammunition from a barrel T to enable the heel 150 corresponding to this barrel T to pass freely through, then raised before another round is fired from the next barrel T. However, when the hang fire safety and firing abort system is activated, the sear G remains in the raised position to form a limit stop during the passage of the heel 150, thus immobilizing the sleeve 140 in rotation and causing the translation of the cam-follower mount 126 which compresses the spring-rings 122*a* and 122*b* of the shock-absorbing device.

According to a second embodiment described hereafter, an opposite operating mode is considered for the sear G. In other words, the sear G is held in a lowered position during the normal operation of the weapon and is only raised further to a misfire or to the activation of the external control for aborting firing in order to, as above, immobilize the sleeve 140 in rotation.

Figure 8:
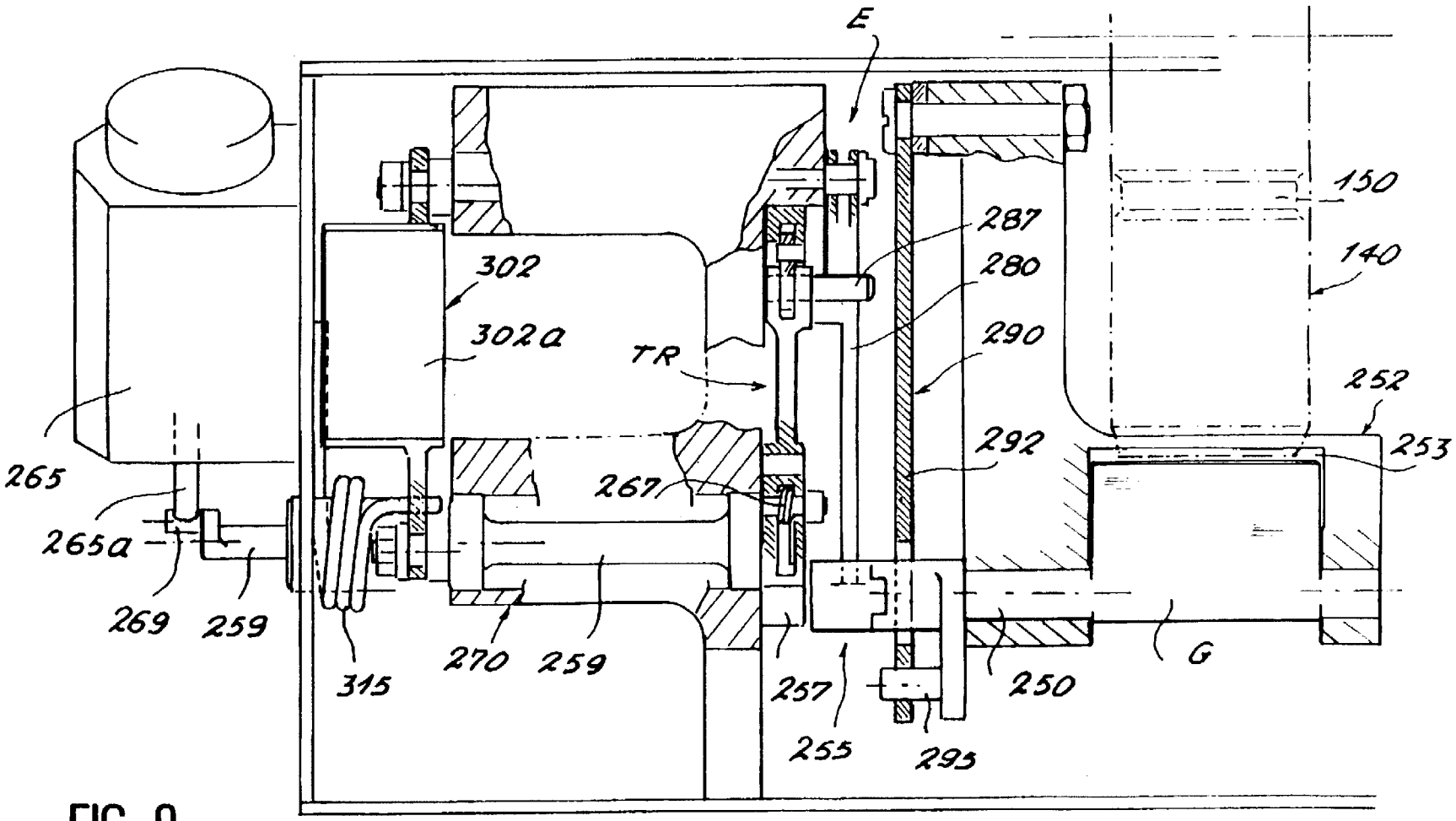
FIG. 8 is a schematic sector view of a firing abort and hang fire safety system according to a second embodiment.
Figure 9:
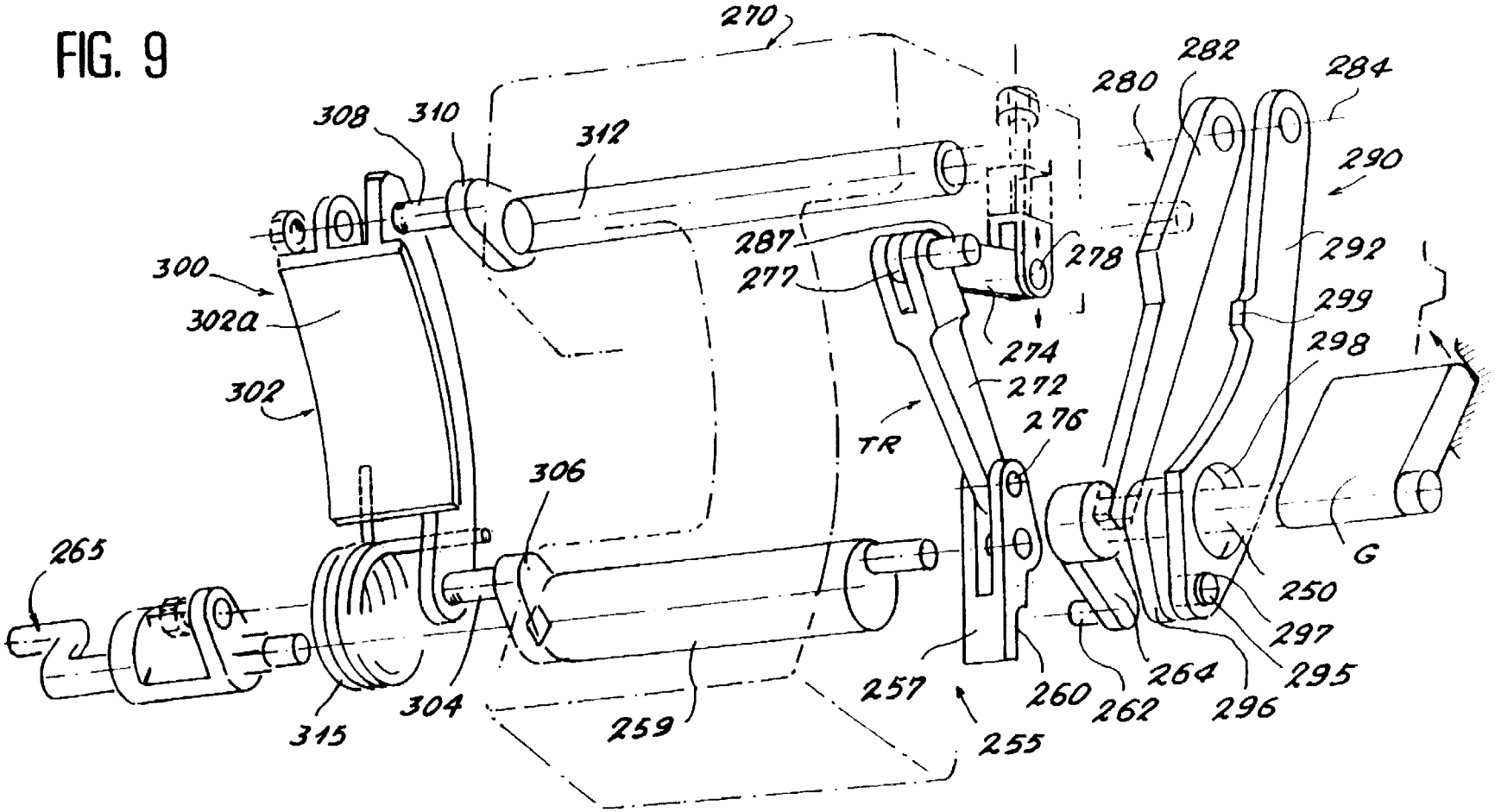
FIG. 9 is an exploded perspective view of FIG. 8.

With reference to FIGS. 8 and 9, the sear G is formed of a flap of a roughly rectangular shape, one side of which forms a limit stop and an opposite side is extended by a rod 250 which provides the hinge pin of the sear G, this axis being parallel to the hinge pin of the revolving assembly 100. The sear G is mounted on a sear support 152 which faces the revolving sleeve 140 and which is immobile in rotation with respect to the revolving assembly 100 of the weapon.

Figure 12:
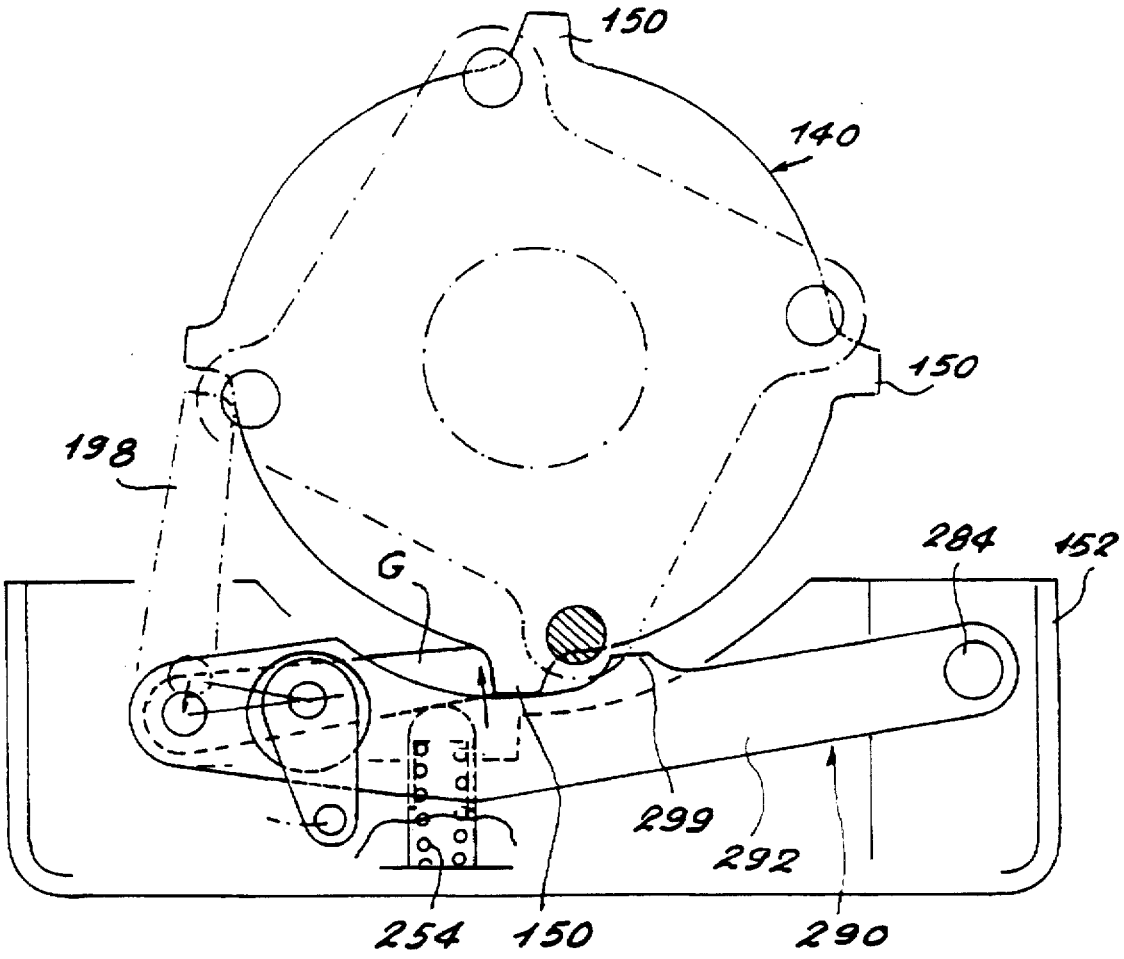

When the sear G is in its lowered position, it is accommodated in a housing 253 of the support 152. A spring 254 is mounted in the bottom of this housing 253 to make it easier to raise the sear G (FIG. 12).

A device 255 is provided to lower the sear G and hold it in a lowered position in which it is outside the course of circular movement of the heels 150 of the sleeve 140.

The device 255 for lowering the sear G includes a pivoting lever 257 mounted in a plane perpendicular to the hinge pin of the revolving assembly 100. More specifically, the lever 257 is mounted free to rotate towards one end of a shaft 259 and includes, at one end, a notch 260 intended to cooperate with an operating pin 262 which is carried by a radial arm 264 integral with the rod 250 of the sear G. The pin 262 is parallel to the rod 250 and off center with respect to the rod, in order to transform the pivoting movement of the lever 257 into a rotational movement of the rod 250, thus swinging the sear G into a retracted position.

With reference to FIG. 8, the pivoting movement of the lever 257 is ensured by a rotational control element 265 of the shaft 259 which supports the lever 257. The rotational movement of the shaft 259 is transmitted with the lever 257 by a spring 267 mounted coaxially to the shaft 259. More specifically, one end of the spring 267 is attached to the shaft 259, whereas its other end bears on the lever 257. Thus, a rotation of the shaft 259 is translated as a pivoting movement of the lever 257.

The control element 265 can be an electromagnet, whose mobile element 265*a* on an off center pin 269 attached to the end of the shaft 259 opposite that which cooperates with the lever 257. Thus, a translational movement of the mobile element 265*a* is translated by a rotational movement of the shaft 259.

The shaft 259 is mounted on a support unit 270 located in the vicinity of the sear support 252. These two supports leave a space E between them in which the lowering device 255 of the sear G is housed. The support unit 270 is immobile in rotation with respect to the revolving assembly 100 of the weapon. Taking into account the firing azimuth of the weapon, the support unit 270 is located upwards of the support unit 152 of the sear G. The electromagnet 265 is located to the side of the support unit 270 which is opposite the space E, and the shaft 259 extends in parallel to the hinge pin of the revolving assembly 100 of the weapon.

The lever 257 which enables the sear G is be lowered is an element of a linkage TR incorporating two other levers 272 and 274 mounted in the extension of lever 257, that is in a plane perpendicular to the hinge pin of the revolving assembly 100.

More specifically, the end of lever 257, opposite the end on which the notch 120 has been arranged, is hinged at one end of the middle lever 272 around an axis 276. The other end of the middle lever 272 is hinged at one end of lever 274 around a hinge pin 277 whereas the other end of lever 274 is hinged at a fixed point around axis 278.

The linkage TR forms a broken line, whose geometry can be changed in circumstances which will be explained later to make lever 257 pivot in the opposite direction to that imparted by the shaft 259.

Figure 11:
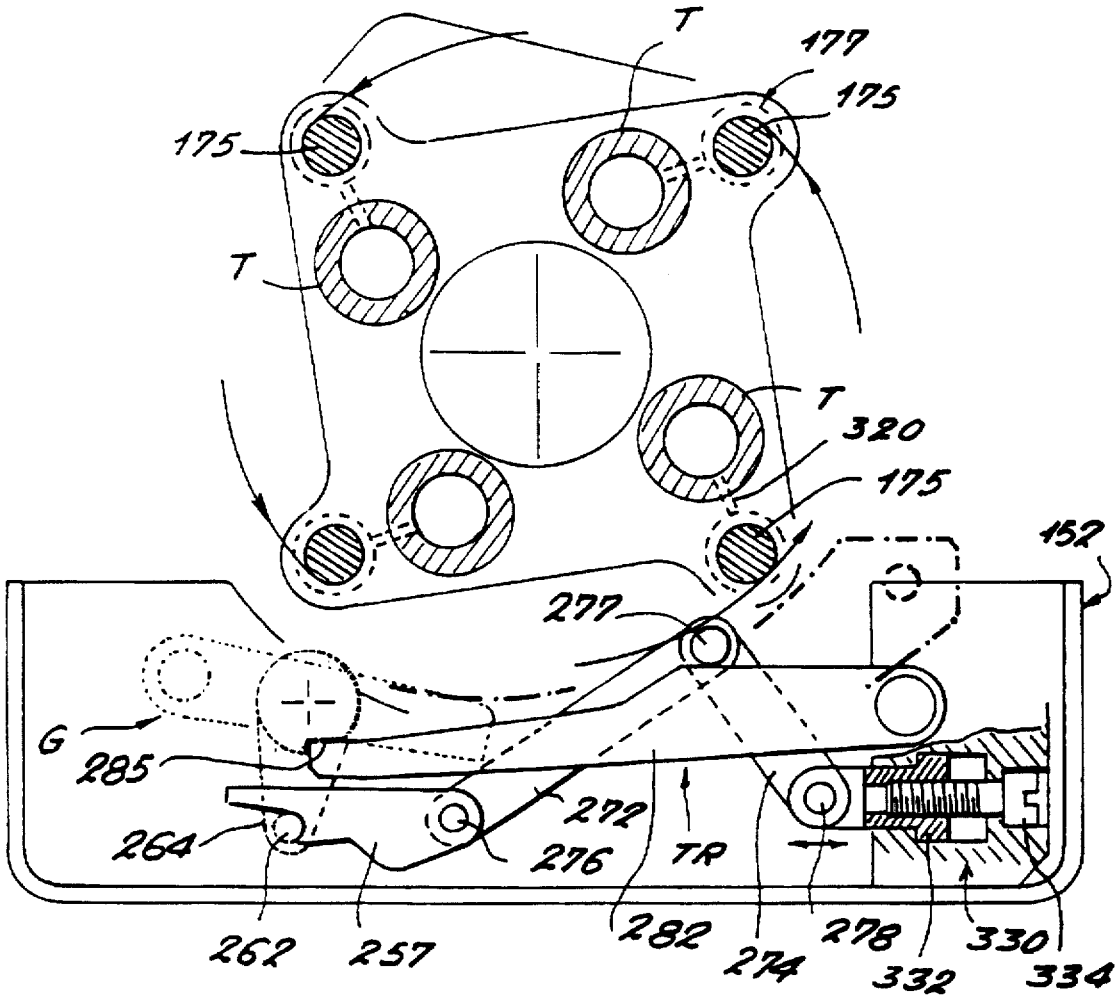
FIGS. 11 to 13 are partial sector views to illustrate the operation of the second embodiment of the firing abort and hang fire safety system.

A device 280 is also provided to immobilizing the sear G when it is in its lowered position. This device 280 incorporates a pivoting lever 282, one end of which is hinged at a fixed point around an axis 284. The other end of the immobilizing lever 282 is intended to penetrate inside a notch 285 arranged in the radial arm 264 which is integral with the rod 250 of the sear G (FIG. 11). The immobilizing lever 282 extends in parallel to the linkage TR, and cooperates with a return spring (not shown) to hold the lever 282 in the position in which it immobilizes the sear G. The pivoting of the lever is controlled by a pin 287 which axially extends the hinge pin 277 provided between the two levers 272 and 274 of the linkage TR, as will be described later.

A device 290 is also provided to raise the sear G. The device is also located in the space E and incorporates a lever 292, one end of which is hinged at a fixed point around the hinge pin 284. The other end of the lever 292 is intended to cooperate with an operating pin 295 to swing the sear G. The pin 295 is supported by a radial arm 296 integral with the rod 250 of the sear G. The pin 295 extends in parallel to the rod 250, is off center and penetrates into a hole 297 provided in lever 292. Thus, a pivotal movement of lever 292 around its axis 294, enables the rod 250 to be driven in rotation by means of the pin 295, thus swinging the sear G into its raised position.

Generally speaking, the lever 292 to for raising the sear G is in parallel to the linkage TR and to the immobilizing lever 282, and it includes an opening 298 to allow the rod 250 of the sear G to pass freely through.

Along its length, lever 292 includes a boss 299 on which each of the control mechanism 170 of the first embodiment can act, notably the piston rod 175 of the jack 177 corresponding to each barrel of the weapon and whose position is controlled by making use of the combustive gases from the round of ammunition fired by this barrel T.

In this second embodiment, the external control 300 for aborting fire incorporates a pivoting sector 302 which is immobile in rotation with respect to the revolving assembly 100 of the weapon.

Sector 302 includes a curved surface 302*a* which forms a cam and which is hingably mounted onto the side of the support unit 270 which is opposite the space E where devices 255 and 290 for lowering and raising the sear G are mounted. More specifically, one end of sector 302 is hinged onto an off center pin 304 carried on a radial arm 306 integral with the drive shaft 259 of the lowering lever 257. The other end of sector 302 is hinged onto an off center pin 308 carried on a radial arm 310 integral with a shaft 312 supported in rotation by the support unit 270 and extending in parallel to the drive shaft 259. Sector 302 can thus pivot in a plane perpendicular to the hinge pin of the revolving assembly 100, its surface 302*a* forming a cam opposite this revolving assembly. Sector 302 is able to pivot between a starting position and a control position, given that a return spring 315 mounted coaxially to the drive shaft 259 includes one end which bears on sector 302 so as to automatically bring it back to the starting position when the electromagnet 265 which controls the rotation of the shaft 259 is not excited.

Figure 10:
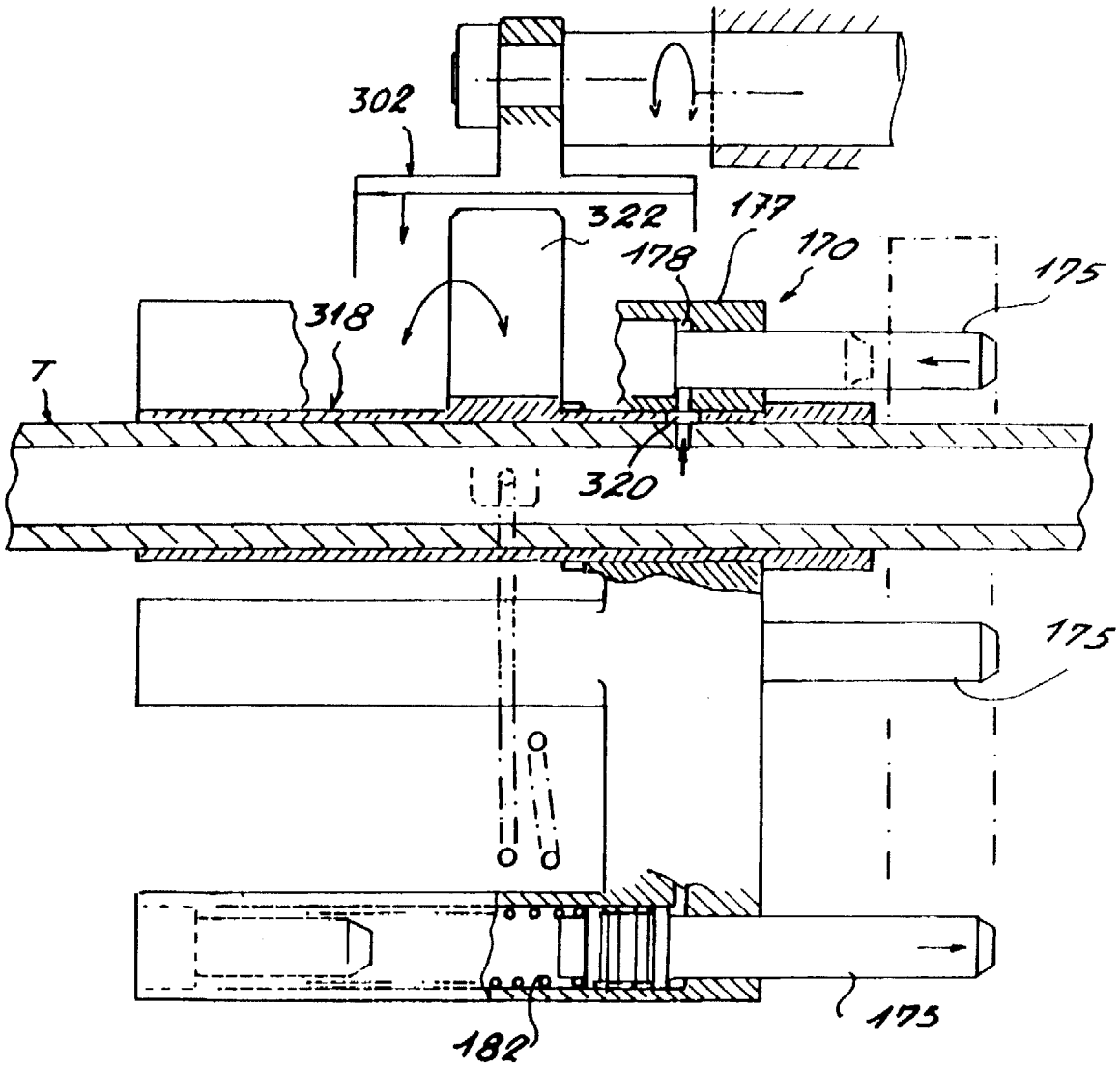
FIG. 10 is a schematic sector view of the firing abort control.

The external control 300 to abort fire also includes a revolving valve 318 mounted around one of the barrels T of the weapon and which is described with reference to FIG. 10. The valve 318 has an opening 320 intended to form a passage for the gases between the barrel T and the cylinder 178 of the jack corresponding to this barrel to control the movement of the piston rod 175 mounted in the cylinder 178. The valve 318 acts as the pawl 189 used in the first embodiment.

The sector 302 is intended to change the position of the valve 318 to break the link between the barrel T and the cylinder 178 of the jack 177 when the external control 300 to abort fire is activated. To this end, the valve 318 includes a radial heel 322, whose free end contacts the cam 300*a* of the sector 302 to pivot the valve 318 around the barrel T supporting it.

The operation of the weapon under normal conditions will now be described for a full revolution of the revolving assembly 100, particular attention will be paid to the rotational movement of the sleeve 140 as for the first embodiment.

According to the operating principle of the second embodiment, the sear G is in the lowered position before a round is fired from any one of the barrels T, and the piston rod 175 of the jack 177 corresponding to this barrel is in the active position. Thus during the rotational movement of the barrel T, the piston rod 175 contacts the linkage TR of the device 155 to lower the sear G and the boss 299 of the lever 292 which raises the sear G.

In order for the sear G to be in its lowered position, the electromagnet 165 is kept under tension so that its mobile element 265*a* rests on the operating pin 269 of the shaft 259 to make the latter carry out a rotational movement which is transmitted to lever 257 of the linkage TR. The notch 260 of lever 257 thus contacts the operating pin 262 which drives the rod 250 of the sear G in rotation in a direction which propels the sear G into its lowered position. Lever 282 of the device 280 for immobilizing the sear G is then engaged in the notch 285 on the radial arm 264 which supports the operating pin 262 (FIG. 11).

When the electromagnet 265 is activated, the firing abort sector 302 is in its starting position and the return spring 315 corresponding to sector 302 is tensed.

As for the first embodiment, operation will be described for one barrel T only of the weapon, the heel 150 of the sleeve 140 corresponding to this barrel T and the control means 170, also corresponding to this barrel T, to change the position of the sear G.

When the barrel T moves into the firing zone, the firing pin 25 corresponding to this barrel is activated, and the round of ammunition loaded in this barrel is fired. Some of the gases resulting from firing the round make their way through the opening 320 in the revolving valve 318 into the cylinder 178 of the jack 177 which corresponds to the barrel T. The piston rod 175 housed in the cylinder 178 then moves axially to take up its starting position, a movement accompanied by the compression of its return spring 182. In these circumstances, during the rotational movement of the barrel T, the piston rod 175 corresponding to this barrel is not able to contact either the linkage TR associated with the device 255 lowering the sear G or with the boss 299 of the lever 292 raising the sear G. In these circumstances, the heel 150 of the sleeve 140 corresponding to the barrel T which has just fired a round passes freely in front of the sear G, as does the heel 150 corresponding to each barrel T of the weapon which fires a round of ammunition during a full revolution of the revolving assembly 100 of the weapon.

A malfunction may occur during firing a round of ammunition from one of the barrels T. In this case, the absence of gases resulting from the round not being fired within a pre-determined lapse of time means that the piston rod 175 of the jack 177 corresponding to this barrel T does not move and remains in its active position during the revolution of the unit 172 supporting the jacks 177. Thus, the piston rod will successively come into contact with the linkage TR and the boss 299 on the device 290 for raising the sear G.

More specifically, the piston rod 175 contacts with the linkage TR in the vicinity of the hinge pin 277 between the two levers 272 and 274. The effect of this contact is to change the broken geometric line made by the linkage TR and force the lever 257 to pivot around so that its notch 260 is released from the operating pin 262 of the sear G. Simultaneously, the pin 287 which extends this hinge pin 277 bears on lever 282 so as to make it pivot around, releasing it from the notch 285 in the radial arm 264 which is integral with the rod 250 of the sear G. In these circumstances, the sear G is released from the lowering device 255. Thereafter, the piston rod 175 contacts the boss 299 on the raising lever 292 which, by means of the operating pin 295, causes the sear G to swing into its raised position (FIG. 12).

The sear G is raised before the heel 150 of the sleeve 140 corresponding to the barrel T passes in front of the sear G, such that the heel 150 abuts to abut against the sear G, thereby causing the sleeve 140 to be immobilized in rotation.

If a volley of fire is required to be aborted, each shot being carried out normally, the external control 300 for aborting firing merely has to be activated and the power supply to the electromagnet 265 cut off.

When the electromagnet is no longer under tension, its mobile element 265*a* is no longer in contact with the operating pin of the shaft 259.

Figure 13:
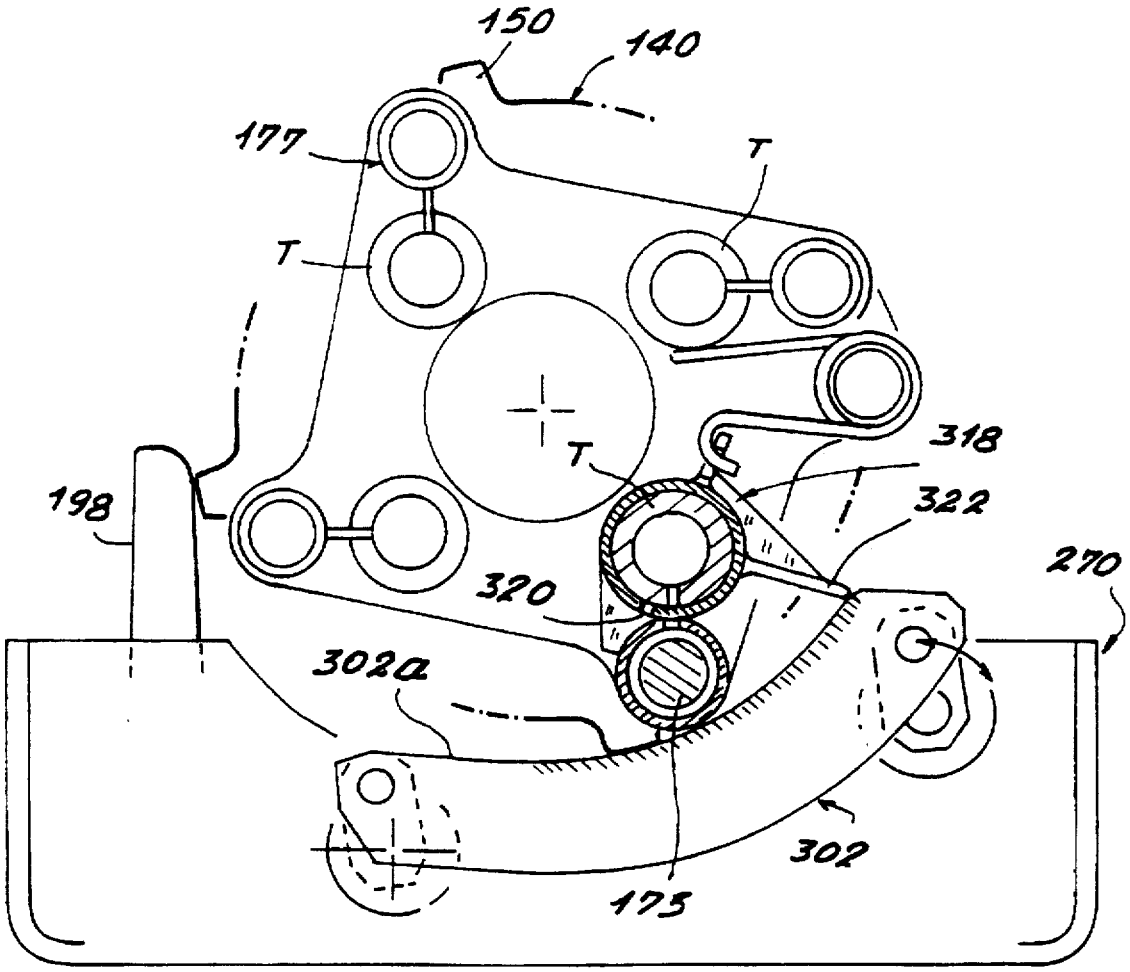

The return spring 315 corresponding to sector 302 can then spring back, thereby moving sector 302 into its active position. In these circumstances, when the barrel T which carries the valve 318 moves into the vicinity of sector 302, the heel 322 of the valve 318 contacts cam 302*a*, thus forcing the valve 318 to revolve around the barrel T, such that the opening 320 of the valve 318 prevents the barrel T and the cylinder 178 of the jack 177 corresponding to this barrel T from communicating with one another (FIG. 13).

In these circumstances, the piston rod 175 housed in the cylinder 178 remains in its active position, so as to be able to raise the sear G and immobilize the revolving sleeve 140. This results in the same conditions of operation as those resulting from the misfire of a round of ammunition.

Thus, as for the first embodiment, a malfunction in firing a round of ammunition and the activation of the external control for aborting fire are translated by the immobilization of the revolving sleeve 140. This immobilization in rotation of the sleeve 140 causes the device 120 to immobilize the revolving assembly 100 of the weapon in rotation, in an identical manner to that described for the first embodiment.

As for the first embodiment, a counter-sear 198 is provided which is armed by a spring and supported by the support unit 152 of the sear G. This counter-sear 198 bears against the heel 150 of the sleeve 140 which precedes the one immobilized by the sear G.

Lastly, the system is advantageously provided with a device 330 to adjust the initial geometric shape of the linkage TR. This device 330 comprises an element 332 which is able to translate under the control of a screw 334 for example and which supports the rotational axis 277 of lever 274.

We claim:

1. A firing abort and hang fire safety system for use with multiple rounds of ammunition and a small or medium calibre multi-barrel automatic weapon that includes multiple barrels having a firing azimuth, a loading and firing system and a body which supports an assembly which is rotatable around an axis parallel to the firing azimuth of the barrels, the firing abort and hang fire safety system comprising:

an apparatus to prevent the assembly from rotating, the apparatus having:

at least one shock-absorber mounted coaxially to the assembly;

an external control to abort firing;

a control device having a cylindrical body which is coaxial to and integral in rotation with the assembly and is also able to translate relative to the assembly; and means for causing translational movement of the body upon either the detection of a misfire of a round of ammunition or the activation of the external control to abort firing, so as to compress the at least one shock-absorber and absorb rotational kinetic energy of the assembly, the means for causing translational movement of the body including a sleeve disposed around the body;

wherein the assembly supports the barrels of the weapon and the loading and firing system so that the barrels each successively fire a round during one full revolution of the assembly under normal operating conditions of the weapon.

2. The system according to claim 1, further including a fixed shaft and wherein the at least one shock-absorber are formed of two stacks of spring-rings respectively housed in two telescopic tubes slidably and coaxially mounted to the fixed central shaft.

3. The system according to claim 2, wherein the fixed central shaft is axially extended beyond the assembly of the weapon, in the direction of fire of said weapon, by a central rod attached to the fixed central shaft by means for coupling whose free end supports a locking ring, and in that the first telescopic tube comprises at one end a bottom wall through which the central rod passes, and in that the second telescopic tube which is intended to engage, by one end also comprising a bottom wall through which the central rod passes, in the other end of the first telescopic tube, and in that the first stack of spring-rings bears on the two bottom walls of the two tubes, and in that the second stack of spring-rings bears on the bottom wall of the second telescopic tube and on the locking ring carried on the free end of the central rod.

4. The system according to claim 1, wherein the means for causing translational movement of the cylindrical body comprise linking means between the sleeve and the cylindrical body for firstly driving the sleeve in synchronization with the cylindrical body and secondly for enabling the translational movement of the cylindrical body with respect to the sleeve, and a device to stop the sleeve in rotation so as to cause the translational movement of the cylindrical body, this stopping device being activated upon either the detection of the misfire of a round of ammunition or the external control to abort firing.

5. The system according to claim 4, wherein the linking means between the cylindrical body and the sleeve is formed of cam-followers supported at the periphery of the cylindrical body and by helicoidal grooves arranged in the sleeve wall, such that each groove receives a cam-follower.

6. The system according to claim 4, wherein the device to stop the sleeve in rotation comprises a plurality of heels evenly spaced at the periphery of the sleeve and a retractable sear immobile in rotation with respect to the sleeve and able to move between a lowered or retracted position and a raised position where the sear is located on the circular course of movement of the heels to immobilize the sleeve in rotation.

7. The system according to claim 6, wherein the number of heels of the sleeve is equal to that of the barrels of the weapon, such as to match each heel to a barrel.

8. The system according to claim 6, wherein the sear is formed of a pivoting flap hinged around a pin supported by a sear support which is immobile in rotation with respect to the revolving assembly and which is mounted opposite the sleeve.

9. The system according to claim 6, wherein, in considering only a full revolution of the sleeve and the rotational direction of the sleeve, the heel associated with a barrel of the weapon passes in front of the sear after the ammunition fired from this barrel has been ignited and before ignition of the ammunition fired from the next barrel.

10. The system according to claim 6, wherein, the passage of the sear into its lowered and/or raised positions is ensured by one of several detection and control means mounted on a support integral in rotation with the revolving assembly of the weapon, these means being sensitive to the pressure of the combustive gases resulting from firing a round of ammunition.

11. The system according to claim 10, wherein the number of detection and control means is equal to that of the barrels of the weapon, such as to match a control means to each barrel.

12. The system according to claim 11, wherein each detection and control means is formed of an element able to move between a retracted position and an active position where it can act upon the position of the sear, the mobile element being able to move from one position to another by making use of the combustive gases of the ammunition fired by the barrel corresponding to the detection and control means.

13. The system according to claim 12, wherein the mobile element is the piston rod of a jack, whose cylinder communicates with the barrel corresponding to the mobile element.

14. The system according to claim 6, further including a raising device, and wherein, under normal operating conditions of the weapon, the sear is in the raised position before a round of ammunition is fired from any of the barrels, and in that the sear is lowered by a lowering device after firing a round of ammunition from one barrel so that the heel of the sleeve then raised by means of the raising device before a round of ammunition is fired by the following barrel, these devices being immobile in rotation with respect to the revolving assembly of the weapon.

15. The system according to claim 14, wherein, under normal operating conditions of the weapon, the devices to lower and raise the sear are successively activated by the mobile element of the detection and control means corresponding to the barrel which has just fired a round of ammunition, the mobile element moving into an active position when the round is fired.

16. The system according to claim 14, wherein the device to lower the sear comprises a pivoting level mounted in a perpendicular plane to the hinge pin of the sear, one end of the lever being hinged around a fixed point, whereas its other end is hinged onto the sear around an axis parallel to the hinge pin, and in that the lever also comprises a boss forming a cam on which a control means can act to lower the sear.

17. The system according to claim 15, wherein the device to raise the sear comprises a cam integral with the sear, the cam having a bearing surface on which a control means can act to raise the sear.

18. The system according to claim 6, wherein, under normal operating conditions of the weapon, the sear is in its lowered position before a round of ammunition is fired from any one of the barrels, and in that the sear is held down by means of a lowering device and raised by means of a raising device, the lowering and raising devices being immobile in rotation with respect to the revolving assembly of the weapon.

19. The system according to claim 18, further including a support, and wherein the hinge pin of the sear is provided by a rod, and the sear is mounted on the support facing the revolving sleeve and which is immobile in rotation with respect to the revolving assembly of the weapon.

20. The system according to claim 19, further including a motor element, and wherein the device to lower the sear is mounted in a perpendicular plane to the rotational axis of the revolving assembly, and comprises a pivoting lever mounted on a shaft parallel to the rotational axis of the revolving assembly the pivoting lever having a notch intended to cooperate with an operating pin carried on a radial arm integral with the rod of the sear, the shaft to control the lever being compelled to rotate by the motor element to force the lever to hold the sear in a lowered position.

21. The system according to claim 20, wherein the lever is mounted free to rotate on the drive shaft, and in that the rotational movement of the drive shaft is transmitted to the lever by a spring.

22. The system according to claim 20, further including a linkage, and wherein the lever to lower the sear is an element of the linkage which forms a broken line, whose geometry is able to vary according to its contact with the mobile elements of the detection and control means to be able to release the sear when the latter has to be raised.

23. The system according to claim 21, wherein the device to raise the sear comprises a pivoting lever intended to cooperate with an operating pin supported by a radial arm integral with the rod of the sear, the lever comprising a boss which, by pivoting when it comes into contact with the detection and control means, controls raising the sear.

24. The system according to claim 19, further including a support unit, and wherein the external control to abort firing comprises a pivoting sector, immobile in rotation with respect to the revolving assembly and mounted hinged on the support unit, and a revolving valve mounted around one of the barrels the revolving valve comprising an opening allowing the combustive gases to pass between the barrel and the cylinder of the corresponding detection and control means.

25. The system according to claim 24, wherein the pivoting sector is able to move between a starting position and an active position where it makes the revolving valve turn at the passage of a radial heel integral with the revolving valve to separate the barrel of the weapon and the cylinder from one another.

* * * * *